US005396997A

United States Patent [19]

Johnson

[11] Patent Number: 5,396,997

[45] Date of Patent: Mar. 14, 1995

[54] SELF-FACING, MULTI-CONTAINER REFRIGERATOR DISPLAY APPARATUS

[75] Inventor: Allen E. Johnson, Hartford, Wis.

[73] Assignee: Oscar Mayer Foods Corporation, Madison, Wis.

[21] Appl. No.: 139,242

[22] Filed: Oct. 19, 1993

[51] Int. Cl.[6] ..... A47F 5/00

[52] U.S. Cl. ..... 211/59.2; 211/74; 312/45

[58] Field of Search ..... 211/59.2, 59.3, 194, 211/74; 312/45, 49, 72, 73

[56] References Cited

U.S. PATENT DOCUMENTS

| | | | |
|---|---|---|---|
| 2,852,327 | 9/1958 | Mason | 312/45 |
| 2,915,162 | 12/1959 | Umstead | 312/45 X |
| 3,286,846 | 11/1966 | Brandes | 312/45 X |
| 3,298,763 | 1/1967 | DiDomenico | 312/45 |
| 3,805,964 | 4/1974 | Titus | 211/592 |
| 4,243,145 | 1/1981 | Woodhead | 312/45 X |
| 4,287,992 | 9/1981 | Takemori | 312/45 X |
| 4,744,489 | 5/1988 | Binder et al. | 312/45 X |
| 4,909,578 | 3/1990 | Abbate | 312/45 |
| 4,998,628 | 3/1991 | Ross | 312/45 X |

*Primary Examiner*—Robert W. Gibson, Jr.
*Attorney, Agent, or Firm*—Lockwood, Alex, Fitzgibbon & Cummings

[57] ABSTRACT

A dispenser display rack includes a body portion having a front end, an opposing rear end, and a pair of upper and lower jar guides having a generally U-shaped cross-sectional configuration. The upper jar guide and the lower jar guide are positioned within the rack body at an angled orientation with respect to each other so that the upper and lower jar guides converge toward each other adjacent the rear end of the rack body. A vertical passageway area is disposed adjacent the rear end of the rack body where the rear end portions of the upper and lower jar guides converge. The upper jar guide further includes an opposed front end portion having a container loading area defined therein adjacent the front end of the rack body. The lower jar guide also includes an opposed front end portion having a container dispensing area defined therein. The vertical shaft area of the dispenser rack is provided with shock-absorbing pads to absorb shocks due to impact of containers moving in the display rack from the upper jar guide, through the shaft area, to the lower jar guide. A plurality of glass jar containers are loaded on their sides through the container loading area. The new and improved dispenser racks successively feed one container at a time to the container dispensing area to thereby provide a self-feeding and self-facing storage, dispensing and display system.

12 Claims, 2 Drawing Sheets

SELF-FACING, MULTI-CONTAINER REFRIGERATOR DISPLAY APPARATUS

BACKGROUND OF THE INVENTION

The present invention generally relates to gravity-feeding racks for storing and displaying a plurality of containers and for dispensing the containers one at a time at a front, forward-facing product unloading area. More particularly, it relates to a vertically oriented rack with a barrel-roll feeding feature adapted to receive and store glass jar containers on their sides for display and dispensing in a supermarket refrigerated display case.

Storage and display devices for displaying a variety of food products in supermarkets are well known. Plastic packaging provides margin portions from which products may be hung on a hook or clamped for suspended display. In the field of a refrigerated or fresh foods, as opposed to staples and dry goods, storage and display devices should not only separate different products in an organized manner, but also preferably will assist store personnel in rotating the stock so that new products are added to the rear of the display for vending after previously stored products have been vended. Maintaining organized displays of distinct products matched to their pricing codes in supermarket shelves is a difficult and time consuming task. Usually, several man hours per week are required to assure proper stock rotation, to re-face the shelves and to manage proper shelf inventories. Refrigerator display cases need to be examined generally at least once every day to monitor the shelf volumes to ensure that sufficient product is placed in the front display cases from rear, walk-in refrigerated storage areas to meet current demands.

Special problems may arise with foods stored in glass jars, especially those which must be stored in refrigeration display cases. The glass jarred products may be loaded onto shelves and freely stacked to form a double layer of product. However, stacking the jars without retaining bins, dividers or shelf guards creates a significant risk of breakage in ordinary supermarket environments. Moreover, the products frequently become mixed and matched which creates a disorganized, unattractive display which is often confusing to shoppers.

Furthermore, stock rotation of free standing glass jar products is difficult. Usually, in refrigeration display cases, space is at a premium and reloading capabilities are difficult. If the product is to be displayed on a refrigerator shelf having another shelf above it, for example, having sufficient clearance for restocking is frequently a difficult problem. In these circumstances, in order to resupply the shelves, older products on the shelf must be taken out or moved onto the floor or adjacent shelving to permit newer products to be installed toward the back of the shelf. Thereafter, the previously stored product must be re-shelved. This is extremely time consuming and presents significant risk of breakage in crowded refrigeration cases where products must be restocked while shoppers are shopping.

Another problem with free-standing stacks of jarred products placed in refrigerator cases is visibility. More particularly, as shelves are continuously re-faced during the day to push the products forward into the display zone at the front of the shelf, it may be difficult to ascertain the quantity of backup product located behind the front display products, because the view may be obstructed by the overhead shelves or lighting may be a problem. Frequently, an item may be sold out before it is noticed that new inventory needs to be brought out from storage. This results in lost sales for both the supermarket owner and the food product manufacturer.

Another major problem associated with free standing stacking of glass jar containers in refrigerator display case environments is that only small amounts of inventory can be stored at a given time. This lack of space means the shelves must be constantly tended, re-sorted, re-faced, re-stocked and rotated, which takes supermarket employees away from other jobs making them unavailable at times for customer check out cashiering and bagging.

Accordingly, to overcome the disadvantages of the prior art display racks, it is an object of the present invention to provide a new and improved display rack storage system providing better shelf and product organization.

It is another object of the present invention to provide a display rack system in which product rotation and shelf re-facing occurs simply and preferably automatically.

It is a further object of the present invention to provide a new and improved display rack storage system which offers better utilization of space, for example, by permitting a larger number of jars to be stored within the same linear feet of shelf space.

It is still another object of the present invention to provide a new and improved storage display rack system which prominently displays the products being merchandised in a neatly-ordered, attractive matter.

SUMMARY OF THE INVENTION

In accordance with these and other objects, the present invention provides a new and improved low profile, multi-container storage, display and dispensing apparatus. The display and dispensing apparatus of this invention is especially adapted to receive and organize a plurality of glass jars having a similar jar size. Preferably, the racks are designed to be universal in that they may receive and organize same size jars selected from a preselected or predetermined number of jar sizes used by a given manufacturer.

The display and dispensing apparatus of this invention comprises a dispenser rack including a body portion having a front end, an opposing rear end, and a pair of upper and lower jar guides having a generally U-shaped cross-sectional configuration. The upper jar guide and the lower jar guide are positioned within the rack body at an angled orientation with respect to each other so that the upper and lower jar guides converge toward each other adjacent the rear end of the rack body. A vertical passageway or shaft area is disposed adjacent the rear end of the rack body where the rear end portions of the upper and lower jar guides converge. The upper jar guide further includes an opposed front end portion having a container loading area defined therein adjacent the front end of the rack body. The lower jar guide also includes an opposed front end portion having a container dispensing area defined therein. The vertical shaft area of the dispenser rack is provided with means for absorbing shocks due to impact of containers moving in the display rack from the upper jar guide, through the shaft area, to the lower jar guide.

In accordance with this invention, a plurality of glass jar containers are loaded on their sides through the container loading area and roll under the influence of gravity along the upper jar guide through the shaft area and along the lower jar guide to the container dispensing area. The new and improved dispenser rack of the present invention successively feeds one container at a time to the container dispensing area to thereby provide a self-feeding and self-facing storage, dispensing and display system.

In a preferred embodiment, the new and improved display rack of the invention has a vertical orientation so that the upper jar guide and the lower jar guide are vertically aligned with the upper jar guide overlying the lower jar guide. The lower product dispensing area preferably projects forwardly from the front end of the rack body generally forwardly of the upper container loading area.

In accordance with a preferred feature, the new and improved dispenser rack body is configured and adapted to fit in vertical tight-fit environments, such as refrigerator shelving areas within a refrigeration display case of a common supermarket in a low-profile manner, i.e., with reduced height requirements. The low profile display rack is provided in a rack having a container loading area defined in the front end of the upper jar guide which includes a rotatable panel or door. The rotatable door is moveable to a lowered loading position to permit new containers to be added through the front face of the display rack, instead of from the top, which reduces the overall height requirements needed for re-stocking.

In accordance with this invention, a plurality of the new and improved dispensing display racks may be interlocked in parallel side by side relation to define a block of shelf space or vending bank for providing an increased amount of stored product in a easy to recognize display. More particularly, in accordance with this invention it has been determined that when a plurality of the new and improved dispensing display racks of the present invention are used in a refrigerator display case in a supermarket to define a vending bank of approximately four lineal feet of shelf space, a 45% increase in product storage for 32 ounce glass jar products and a 55% increase in product storage for 28 ounce jar containers was achieved. The new and improved dispenser display racks actually store more product in a better organized manner than prior art arrangements.

Other objects and advantages of the present will become apparent from the following detailed description, taken in conjunction with the drawings, in which:

DETAILED DESCRIPTION OF THE PREFERRED EMBODIMENT

Figure 1:
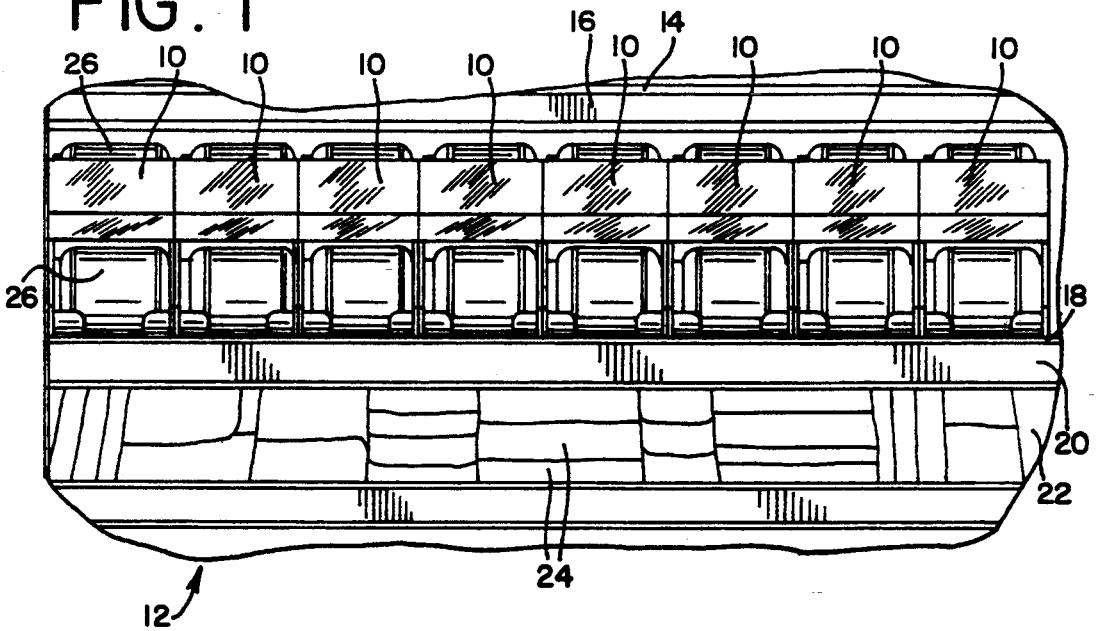
FIG. 1 is an elevation view of a supermarket refrigerator display case shelf on which a plurality of the new and improved storage dispensing display racks of the present invention have been assembled together to provide an organized product display.

Referring now to FIG. 1, a generally linear array of eight adjacent dispensing display rack devices in accordance with the present invention generally referred to by reference numeral 10, are shown in use in a supermarket refrigerated display unit 12. Refrigeration unit 12 includes an upper shelf 14 with a price bar 16, a middle shelf 18 with a price bar 20 and a lower, angled, forwardly projecting bin section 22, shown stocked for purposes of illustration with sealed plastic packages 24 which may contain foodstuffs requiring refrigerated storage, such as luncheon meats, bacon, sausage products, hot dogs as well as dairy products such as butter, cheese and the like. In accordance with the preferred embodiment, display racks 10 are configured and adapted to receive, store, display and dispense products in glass jars 26, such as fresh processed pickles, relishes, condiments and the like which are not cooked and, therefore, are required to be refrigerated. Display racks 10 receive the jars 26 on their sides and the jars 26 are gravity fed along jar guide ramp surfaces provided in the rack 10 so that the jars 26 roll in barrel roll fashion from an upper front container loading area 30, towards the rear of the rack 10, into the page as viewed in FIG. 1, and then forwardly, toward the viewer, until received in the lower, forward container dispensing area 32.

Racks 10 are provided to store a plurality of glass jar containers in a self-facing, self-feeding organized manner which does not require any special or excess vertical height requirements for use. Preferably, the display racks 10 may be secured together to define a locked-in, easily recognized block of shelf space for receiving products from an easily identified supplier. In accordance with a preferred feature, the racks 10 are specially configured to receive a plurality of same-sized having a jar size selected from a few predetermined jar sizes. In this way, a few different products may be revealed in the display racks which group the products within a dedicated vending bank or shelf area associated with a single supplier. Preferably, the rack 10 additionally provides its own graphical display panel area 28 to promote brand recognition and product recognition by providing an advertising surface for receiving graphical designs, logos and other written indicia.

In greater detail and referring now to FIGS. 2–6, the dispenser display rack 10 comprises an open topped generally rectangular body 40 including an upstanding end wall 42, at a rear end 44, and a pair of parallel spaced apart upstanding sidewalls 46 and 48 extending normally and forwardly from opposed sides of end wall 42. Rack body 40 also includes a front end 50 wherein the container loading area 30 and the container dispensing area 32 are located. Accordingly, rack body 40 has an associated width dimension w, generally defined between upstanding sidewalls 46 and 48, a length dimension, 1, defined between front end 50 and rear end 44.

Figure 2:
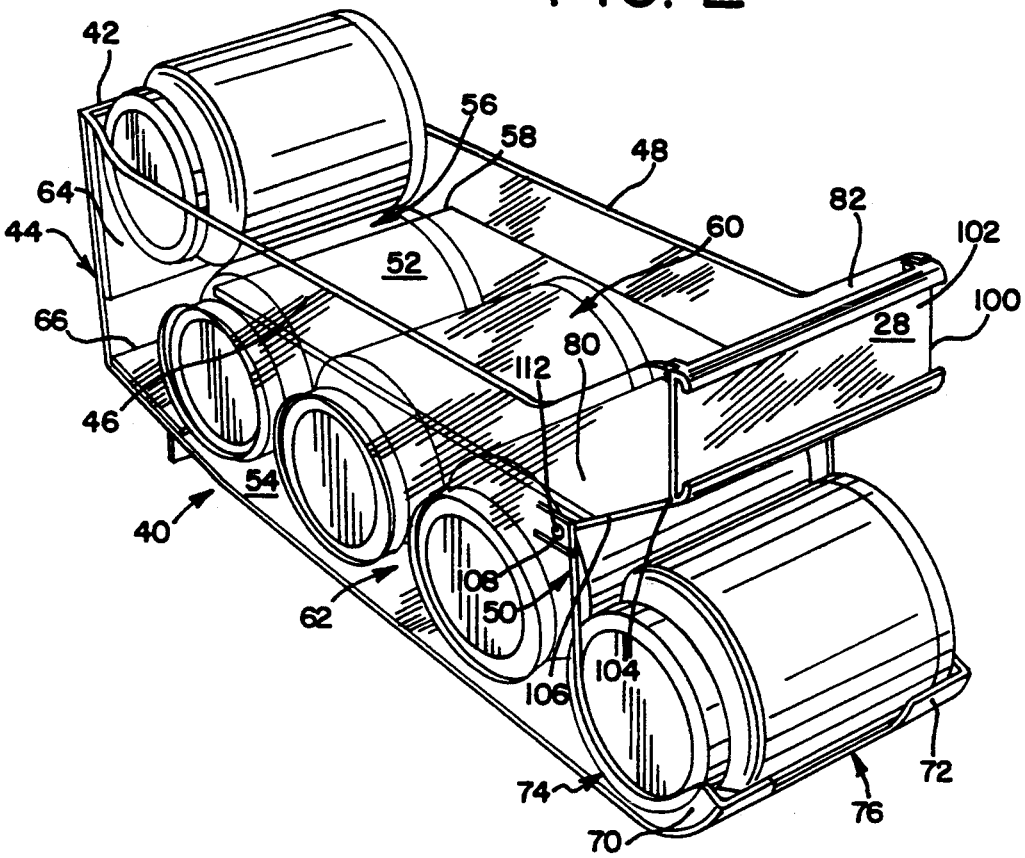
FIG. 2 a perspective view of the new and improved storage and display rack of the present invention.
Figure 3:
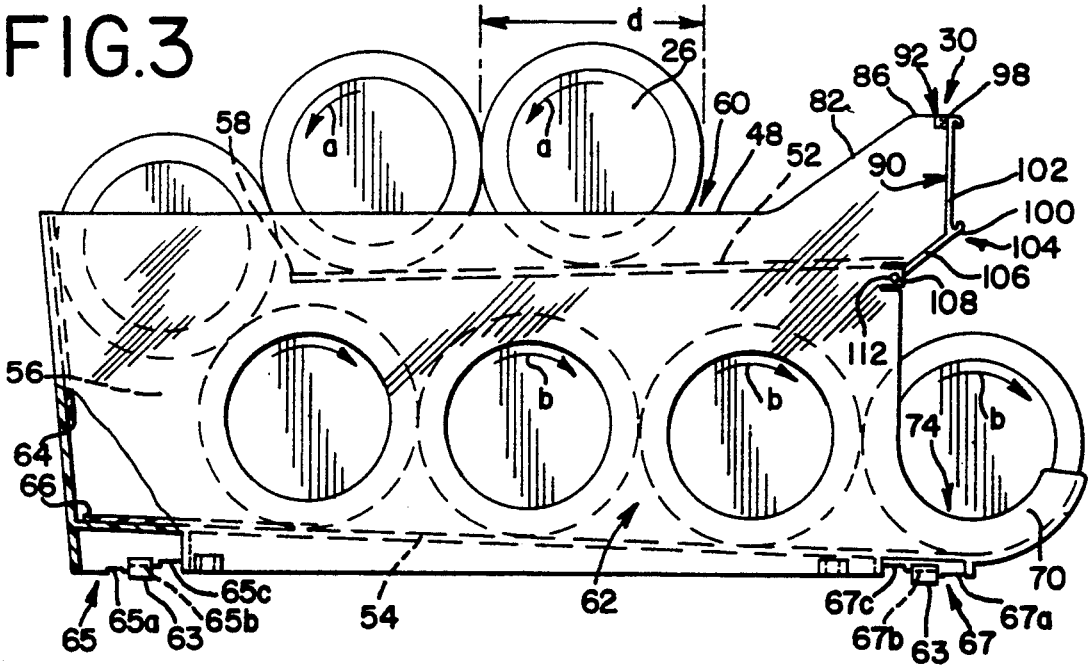
FIG. 3 is a side elevation view of the new and improved storage and display rack of the present invention with portions cut away and in section to illustrate protective shock absorbing features in accordance with the preferred embodiment.

In the preferred embodiment depicted in FIGS. 14, rack body 40 also includes an upper ramp partition 52 extending generally perpendicularly between sidewalls 46 and 48 intermediate the height of sidewalls 46 and 48 and extending from front end 50 to a point intermediate the length of rack body 40. A lower ramp partition 54 extends generally perpendicularly between sidewalls 46 and 48 adjacent lower ends thereof from rear wall 44 to the front end 50 adjacent the container dispensing area 32. A vertically extending shaft area or passageway 56 extends adjacent rear end wall 42, above a rear end portion of lower ramp 54 and between a rear end 58 of upper ramp 52 and the end wall 42. As is shown in FIGS. 2 and 3, the upper ramp partition 52 and the lower ramp portion 54 with the upstanding sidewalls 46 and 48 to define a generally three-sided, upper jar guide 60 and a lower jar guide 62 each having a generally U-shaped cross-sectional configuration. The upper jar guides 60 and lower jar guide 62 are defined in rack body 40 so that they are disposed at an angled orientation with respect to each other and so that they converge toward each other adjacent the rear end 44. A pair of shock absorbing pads 64 and 66 are positioned in the vertical shaft area 56 along a inner-facing surface of rear end wall 42 and on the upper, inner-facing surface of lower ramp 54 adjacent rear end 44. Shock absorbing and sound absorbing pads 64 and 66 are made from a resilient compressible material capable of absorbing shocks from impacts, permitting the glass jars 26 to roll and bump against end wall 42 and ramp 54 without breakage. Preferably, pad 64 should also have frictional surface characteristics toward the glass sidewalls of jars 26 to facilitate changing the direction of rotation for the jars 26 from the counter-clockwise direction shown by arrows, a, in FIG. 3, as the jars roll front to back from the container loading area 30 to the rear end 58 of upper ramp 52, to the clockwise direction shown by arrows, b, in FIG. 3, as the jars 26 roll back to front from the rear vertical shaft area 56 to the front end 50 and the container dispensing area 32. The distance defined between the surface of vertical shock absorbing pad 64 and the rear end 58 of upper ramp 52 is preferably slightly greater than the diametrical dimension, d, of the glass jars 26 to provide free, unhampered clearance for the jars and to provide for travel of one jar at a time through the rear shaft area 56.

The downwardly angled slope from front to back for upper ramp 52 should be gentle to avoid breakage but sufficient to cause the loaded jars 26 to roll toward shaft area 56 to provide for self-feeding of the jars 26 under the influence of gravity. The downwardly angled slope from back to front of the lower ramp 54 should also be gentle to avoid impact and breakage of the jars but sufficient to permit the jars to roll and feed toward the dispensing area 32. In accordance with the preferred embodiment depicted in FIGS. 2 and 3, the relative angles of the upper and lower ramps may be adjusted or corrected by placing small removable rubber foot pads 63 on height adjustment ridges 65 and 67 provided in the bottom portion of rack body 40 adjacent the corners at front end 50 and the rear ends 44, respectively. As depicted in the drawings, three height adjustment levels 65*a*, 65*b* and 65*c*, as well as 67*a*, 67*b*, and 67*c* are shown provided at each corner to permit raising or lowering of the rear end 44 or front end 50 of the rack body 40, respectively, to correct for unevenness of the refrigerator shelf 18 and to adjust jar ramp speeds.

Referring again to FIGS. 2–5, the new and improved dispenser display racks 10 in accordance with the present invention preferably include a container dispensing area 32 projecting forwardly from the lower front end of rack body 40. Container dispensing area 32 is defined by a pair of spaced apart, curving semi-circular arm portions 70 and 72 defining a jar receiving cradle area 74 therebetween. A gap or space 76 defined between the arms 70 and 72 facilitates hand grip access, enabling the forward most jar in the container dispensing area to be gripped in the center thereof and lifted and removed from the cradle area and rack. Forward end surfaces in the curving areas 70 and 72 are effective to define forward stops to prevent further rolling of the gravity fed jars along lower jar guide 62.

In accordance with an important aspect of this invention, preferred display rack 10 is provided with a low profile container loading area 30 defined adjacent the front end of upper jar guide 60. Container loading area 30 includes a pair of angled tab projections 80 and 82 extending upwardly and forwardly from sidewalls 46 and 48 at front end 50. The opposed free ends 84 and 86 of tabs 80 and 82 include front vertically oriented edge surfaces 88 and 90, respectively. A locking ledge projection 92 and 94 adapted to cooperatively engage locking arm projections 96 and 98 on a rotatably mounted door panel 100 are provided an inner facing surfaces of tab projections 80 and 82 adjacent the upper ends of tabs 80 and 82, respectively. Rotatable door panel 100 has an angled orientation including a vertical upper arm portion 102, an intermediate elbow or bend 104, and a lower angle arm portion 106. A pair of outwardly projecting pivot pins 108, 110 project outwardly from the sides of lower arm portion 106 which are received in pin-receiving recesses 112 and 114 defined in sidewalls 46 and 48, respectively, adjacent front end 50. Door panel 100 is rotatably hingedly mounted to rock body 40 at a location which is removed inwardly and downwardly from vertical edge surfaces 88 and 90, respectively, when door panel 100 is swung downwardly to an open position beyond that shown in FIG. 5, through the front opening 116 directly onto upper ramp 52 in upper jar guide 60, without needing additional height for loading. In accordance with the rack of the present invention, loading occurs through the openable upper jar guide 60 in the front end of the rack 40.

Figure 4:
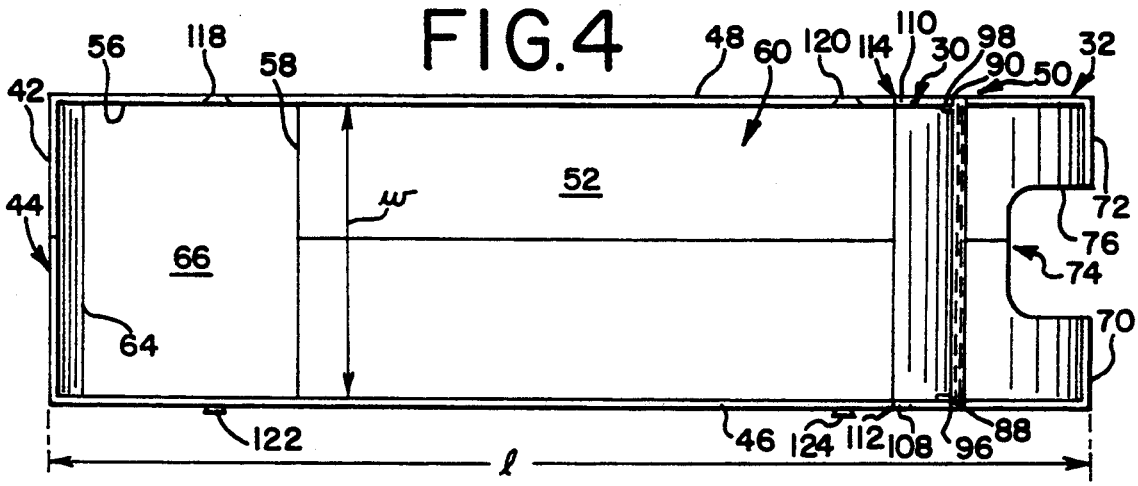
FIG. 4 is a top plan view of the new and improved storage dispensing display rack of the present invention.
Figure 5:
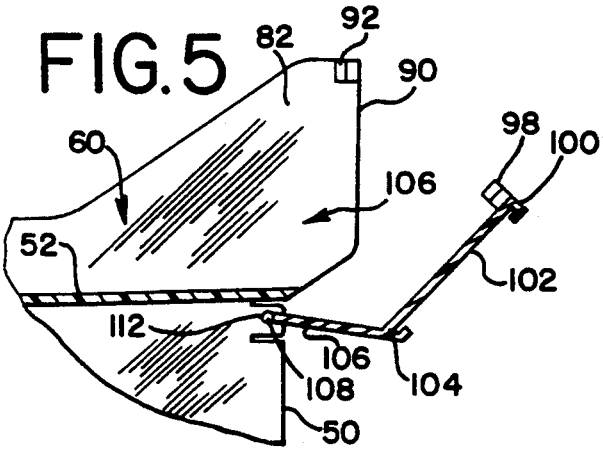
FIG. 5 is an enlarged, elevated fragmentary view, partly in section, showing the container loading area of the new and improved storage dispensing and display rack of the present invention.
Figure 6:
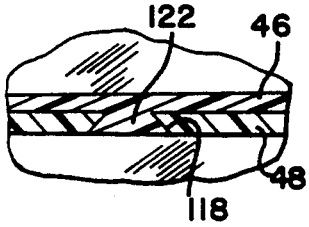
FIG. 6 is an enlarged, fragmentary cross-sectional view from the top showing the cooperating interlocking tongue and groove members in accordance with the preferred embodiment for locking a pair of the new and improved storage dispensing display racks of the present invention and assembled side by side parallel relationship to define a block of space for receiving a given product or group of products.

In accordance with a preferred embodiment, means for releasably locking a pair of racks 10 together in parallel side by side relationship are provided in a pair of groove or recess portions 118 or 120 defined in an upper end of sidewall 48 adapted to receive a pair of projecting tongues 122 and 124 extending outwardly from upper end portions of sidewall 46, as shown in FIGS. 4 and 6 for forming a bank of display racks 10, as shown in FIG. 1.

In accordance with the present invention, display racks 10 preferably are shaped molded articles molded from impact resistant, resilient thermoplastic polymer materials. Illustrative moldable thermoplastics include polyolefins, polyesters, polyacrylates, polycarbonates and polyamides such as nylon type materials. High impact polystyrene resins are presently the preferred thermoplastic molding materials. In an especially preferred embodiment, rack body 40 is molded in two generally symmetrical housing halves, effectively splitting or dissecting the housing body 40 along a central, longitudinal axis into two parts indicated at seam line 126 in FIG. 4. The two part housing and the door panel 100 may be assembled together so that the pivot pins 108, 110 are received in their respective pin-receiving recesses 112, 114 and so that inward longitudinal edges on each housing half are brought into abutting relation to each other. Thereafter, the abutting edges may be heat sealed, sonically-welded or solvent sealed to form a central joint 126 securing the three piece assembly fixedly together. The sound and impact absorbing pads 64 and 66 preferably comprise thermoplastic elastomeric foam or sheet stock affixed to the rock body by suitable securement means, such as by adhesive bonding or mechanical fastening methods.

In accordance with the preferred embodiment, the upper and lower jar guides 60 and 62 are enclosed or defined within the protective sidewalls 46 and 48 of the rack body 40. Other jar guides generally cantilevered from a rack frame member may also be substituted.

In accordance with the present invention, the new and improved rack 10 provides easy detection of product sell outs upon visual inspecting the container dispensing areas. Easy product loading through the container loading area automatically provides first in—first out product rotation and also provides a self-feeding and facing low maintenance product display.

The present invention also provides a display rack with an extended forwardly projecting container dispensing area and an elongate serpentine product flow pathway which permits a larger number of jars to be stored therein, on their sides, in a refrigerator shelf of a given height, then may be stocked in the same space in a loose, free-standing stacked array. It has been determined that in utilizing the racks of the present invention better utilization of shelf space was obtained providing a 45% increase in holding power for a 32 ounce jar system and a 50% increase in holding power for a 24 ounce jar system.

Although the present invention has been described with reference to a preferred embodiment, modifications or changes may be made therein by those skilled in this art, without depending from the scope and spirit of this invention as defined by the appended claims.

What is claimed is:

1. A low profile, multi-container storage, display and dispensing apparatus for receiving and organizing a plurality of glass jars having a similar jar size selected from a predetermined number of jar sizes, said apparatus comprising:

a dispenser rack including a body portion having a front end, an opposing rear end, an upper and a lower jar guide segment, each jar guide segment having a generally U-shaped cross-sectional configuration, said upper jar guide segment and said lower jar guide segment being disposed at an angled orientation with respect to each other such that the upper and lower jar guide segments converge toward each other adjacent the rear end of said rack body, a vertical shaft area disposed adjacent the rear end of the rack body where rear end portions said upper and lower jar guide segments converge, said upper jar guide segment including an opposed front end portion having a container loading area defined therein adjacent the front end of said rack body, said container loading area includes a rotatable panel moveable between a lowered, loading position wherein the panel extends forwardly from the front end of said upper jar guide to facilitate access to said upper jar guide and a raised, closed position wherein the panel extends generally perpendicularly with respect to said upper jar guide segment thereby closing off access to said upper jar guide, said lower jar guide segment including a front end portion having a container dispensing area defined therein, said vertical shaft area including at least one shock absorbing member to absorb shocks due to impact of containers moving in said display rack from said upper jar guide segment through said shaft area through said lower jar guide segment, whereby a plurality of glass jar containers may be loaded on their sides through the container loading area and thereafter roll under the influence of gravity along the upper jar guide segment, through the shaft area and along the lower jar guide segment to the container dispensing area to successively provide one container at a time at the container dispensing area and such that a self-feeding and self-facing storage and display rack is provided.

2. A display rack as defined in claim 1, wherein said upper jar guide and said lower jar guide are vertically aligned so that the upper jar guide overlies the lower jar guide.

3. A display rack as defined in claim 2, wherein said container dispensing area projects forwardly from the front end of said rack and said container loading area.

4. A display rack as defined in claim 3, wherein said container dispensing area is defined by a pair of spaced and opposed curved arm portions projecting from the front end of the lower guide segment and configured to receive a single container at a time disposed therein, said curved arm portions being spaced apart so that a container in said dispensing area may be gripped at a central area thereof located between said arm portions and lifted out of said rack and so that upon removal of the forward-most container from said dispensing area, remaining containers are permitted to roll forwardly along the jar guides until a next successive container is deposited in the container dispensing area.

5. A dispenser rack as defined in claim 1, wherein said shock absorbing means comprises a pad of resilient, compressible, shock-absorbing material disposed along a lower surface in said shaft area adjacent a rear end portion of said lower jar guide.

6. A display rack as defined in claim 5, wherein said shock absorbing means further comprises a pad of resilient, compressible, shock-absorbing material disposed on an upstanding sidewall surface portion in said shaft area opposite the rear end of said upper jar guide.

7. A display rack as defined in claim 1, wherein said rotatable panel has includes a pair of pivot pins projecting outwardly from opposed sides of said panel adjacent a lower major edge thereof, said pivot pins being received in a pair of pin receiving recesses defined in said rack body adjacent the front end thereof and pivotally mounting said panel adjacent the container loading area.

8. A display rack as defined in claim 7, wherein said rotatable panel further includes means for releasably locking the panel in its raised closed position.

9. A display rack as defined in claim 8, wherein said panel further includes an outwardly facing graphical display surface.

10. A display rack as defined in claim 1, wherein said rack body is defined by a pair of generally symmetrical housing halves joined together along a longitudinally extending central seam portion.

11. A display rack as defined in claim 9, wherein said housing comprises an impact-resistant thermoplastic molded article.

12. A display rack as defined in claim 1, wherein said shock absorbing means comprise a pad of thermoplastic elastomer material secured to said rack body.

* * * * *

UNITED STATES PATENT AND TRADEMARK OFFICE

CERTIFICATE OF CORRECTION

PATENT NO. : 5,396,997

DATED : March 14, 1995

INVENTOR(S) : Allen E. Johnson

It is certified that error appears in the above-indentified patent and that said Letters Patent is hereby corrected as shown below:

Col. 1, line 18, delete "a".
Col. 2, line 42, after "preselected" insert --number--.
Col. 3, line 34, "a easy" should read --an easy--; line 46, after "present" insert --invention--; line 56, after "FIG. 2" insert --is--.
Col. 4, line 46, after "same-sized" insert --jars--; line 67, replace "1" with --l-- (the letter).
Col. 5, line 1, replace "14" with --1-4--; line 15, after "portion 54" insert --cooperate--; line 24, "a inner-facing" should read --an inner-facing--.
Col. 6, line 24, "A locking" should read --Locking--; lines 24-25, replace "projection" with --projections--; line 27, replace "an" with --on--.
Col. 7, line 38, replace "depending" with --departing--; line 57, after "portions" insert --of--.
Col. 8, line 46, delete "has".

Signed and Sealed this

Ninth Day of July, 1996

*Attest:*

Bruce Lehman

BRUCE LEHMAN

*Attesting Officer*

*Commissioner of Patents and Trademarks*